US005842506A

United States Patent [19]

Peters

[11] Patent Number: 5,842,506

[45] Date of Patent: Dec. 1, 1998

[54] HAND TOOL FOR FORMING AND APPLYING WIRE TIES

[76] Inventor: Rudolph W. Peters, 5786 Balmoral Dr., Oakland, Calif. 94619

[21] Appl. No.: 928,978

[22] Filed: Sep. 12, 1997

[51] Int. Cl.[6] ..... B21F 15/04

[52] U.S. Cl. ..... 140/119; 140/57

[58] Field of Search ..... 140/57, 93.6, 118, 140/119

[56] References Cited

U.S. PATENT DOCUMENTS

| | | | |
|---|---|---|---|
| 3,786,841 | 1/1974 | Albrecht et al. . | |
| 3,881,684 | 5/1975 | Daniels, Jr. . | |
| 4,354,535 | 10/1982 | Powell et al. | 140/119 |
| 4,542,773 | 9/1985 | Lafon . | |
| 4,685,493 | 8/1987 | Yuguchi . | |
| 4,762,154 | 8/1988 | Cianciullo . | |
| 4,798,231 | 1/1989 | Glaus et al. . | |
| 4,834,148 | 5/1989 | Maguruma et al. . | |
| 4,838,726 | 6/1989 | Huerta . | |
| 4,941,515 | 7/1990 | Vrenning . | |
| 4,947,902 | 8/1990 | Lehmann et al. . | |
| 4,953,598 | 9/1990 | McCavey . | |
| 5,178,195 | 1/1993 | Glaus et al. . | |
| 5,217,049 | 6/1993 | Forsyth . | |
| 5,323,816 | 6/1994 | Hoyaukin . | |
| 5,431,196 | 7/1995 | Forrester, Jr. et al. . | |
| 5,501,251 | 3/1996 | Vader et al. . | |
| 5,605,181 | 2/1997 | Vuong . | |
| 5,613,530 | 3/1997 | Kincel et al. . | |

FOREIGN PATENT DOCUMENTS

| | | | |
|---|---|---|---|
| 554050 | 4/1977 | Russian Federation | 140/57 |

OTHER PUBLICATIONS

RB262/RB472 RE* Bar–Tier (flyer) Max Co., Ltd.

*Primary Examiner*—Lowell A. Larson
*Attorney, Agent, or Firm*—Harris Zimmerman

[57] ABSTRACT

A hand tool for forming and installing wire ties to join rebar segments includes an extended barrel portion having a loop-forming yoke projecting distally therefrom. Within the barrel, a motor-driven wire cutting and twisting apparatus is closely proximate to the yoke. The yoke is provided with a hook shape to receive the bars, and a guide groove to form a half loop of wire about the pair of bars disposed within the hook confines of the yoke. An end plate at the distal end of the barrel includes a diametrical slot having a wire outlet opening at one end in registration with the opening of the wire guide groove in the yoke. At the other end of the slot, an inlet opening is disposed to receive the wire end from the half loop formed by the guide slot of the yoke. A wire guide mechanism directs the wire end from the guide groove of the yoke to the inlet opening of the end plate of the barrel. A rotatable wire twisting disk is disposed proximally to the end plate, the disk including a pair of inwardly spiraling slots disposed to engage the two legs of the wire loop. In addition, a wire cutoff tool is disposed proximally to the disk to severe one leg from a wire feed supply. A sliding mounting bracket supports the yoke at the distal end of the barrel. The mounting bracket translates parallel to the axis of the barrel, whereby at the end of the wire twisting cycle the tool handle is pulled to cause the yoke to displace from the barrel and withdraw the twisted wire loop from the tool.

36 Claims, 11 Drawing Sheets

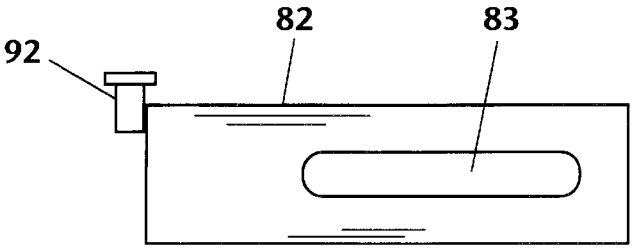
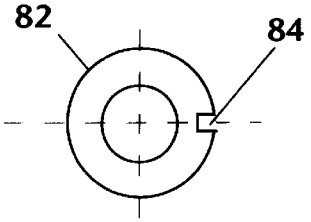
FIG. 13
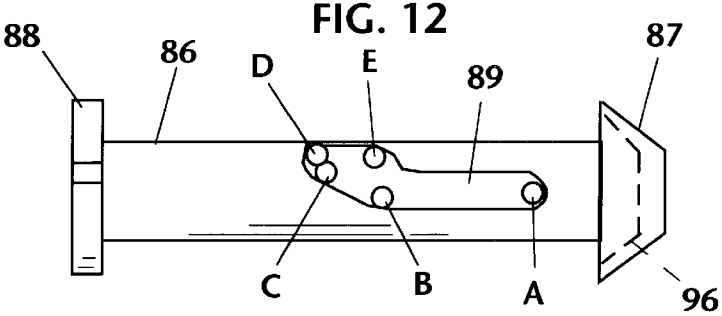
FIG. 12
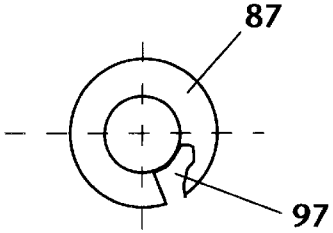
FIG. 15
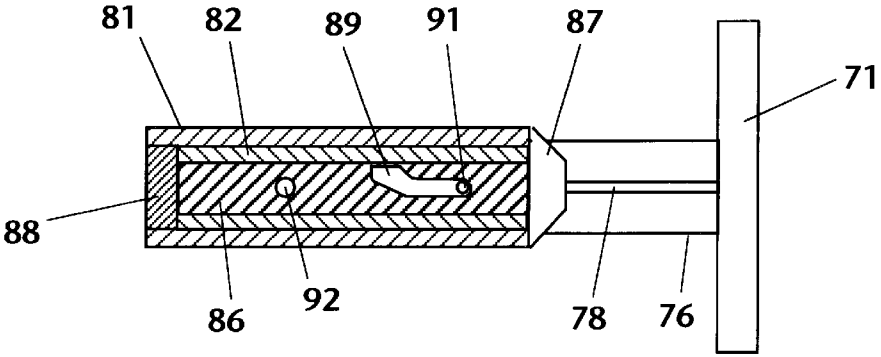
FIG. 17
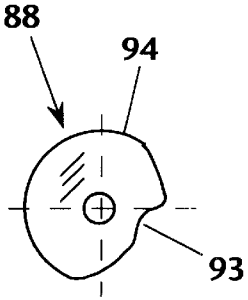
FIG. 16

HAND TOOL FOR FORMING AND APPLYING WIRE TIES

BACKGROUND OF THE INVENTION

The present invention generally relates to wire ties for joining intersecting adjacent rods, and more particularly to tools for forming and twisting wire ties to join reinforcing bars (rebar) in a concrete reinforcing structure prior to pouring the concrete.

In the formation of concrete structures, it is commonplace practice to embed reinforcing bars (rebar) in the concrete to add tensile strength, load strength, and torsional resistance. Rebar is typically laid up within a concrete casting form, using rebar units to form a grid of parallel and intersecting rods. To be effective, the individual rods must be joined at parallel ends and intersecting points to form a rigid reinforcing structure. The joining process is usually carried out using wire ties applied at the intersecting points of the grid.

There may be thousands of junction points in a single concrete reinforcing structure, which previously have been joined manually by twisting wire ties thereabout. The cost of such labor is far too great on large-scale projects. Therefore, there have been developed in the prior art many different forms of rebar tying devices. Generally, these devices also use wire ties twisted in situ to form a connection, and differ primarily in the use of either pre-formed wire ties or a wire supply that is cut, formed, and twisted in place.

None of the prior art devices have gained notice or achieved success in the construction business. In the harsh environment of construction projects, tools must be able to endure abuse while functioning reliably. The rebar tying task in particular requires a hand tool that is light weight, portable with its power supply, and capable of sustained use. Apparently no prior art device has provided these attributes.

SUMMARY OF THE PRESENT INVENTION

The present invention generally comprises a portable hand tool for forming and installing wire ties to join rebar segments or the like and form a rigid structure therewith. The hand tool is provided with a pistol-like conformation, with an extended barrel portion having a wire-forming yoke projecting distally therefrom. Within the barrel, there is a wire cutting and twisting apparatus in close proximity to the yoke, and a motor to drive this apparatus. Within the conjunction of the barrel and handle portions of the tool, a wire feed mechanism is disposed to receive wire from an external supply and feed the wire distally to the yoke. A wire feed motor is disposed within the handle portion, and a rechargeable battery is secured to the lower end of the handle portion. A pushbutton control is disposed at the vertex of the included angle between the barrel portion and handle portion. The pushbutton is connected to a control circuit, which in turn operates the wire feed motor and the cut and twist motor in proper sequence and timing.

In one aspect of the invention, the yoke is provided with a hook shape, and is dimensioned to received a pair of reinforcing bars or the like. The yoke is provided with a guide groove having one portion extending linearly and distally from the barrel, and a distal portion of the guide groove is curved retrograde approximately 180°. The feed mechanism drives the end of the wire into the groove, and the wire end follows the groove to form a half loop about the pair of bars disposed within the hook confines of the yoke.

In another aspect of the invention, the wire cutting and twisting apparatus includes an end plate at the distal end of the barrel, with a slot extending diametrically in the plate. An outlet opening at one end of the slot is in registration with the opening of the wire guide groove in the yoke, whereby the wire may be directed from the feed mechanism to enter the guide groove. At the other end of the slot, an inlet opening is disposed to receive the wire end from the half loop formed by the guide slot of the yoke, whereby the wire end re-enters the barrel.

The wire cutting and twisting apparatus further includes a rotatable disk disposed proximally to the end plate. The disk is provided with a pair of curved slots disposed symmetrically with respect to the axis of rotation of the disk. Each slot is curved in a partial spiral, with the outer ends of the slots disposed in registration with the inlet and outlet openings of the end plate, whereby the wire extends through the slots as it exits the barrel and re-enters the barrel. At the converging inner ends of the slots, a pair of latches are disposed to secure the wire therein. In addition, a wire cutoff tool is disposed proximally to the disk, and is driven by the shaft connected to the disk, whereby the wire portion extending out of the end plate is severed from the wire feed supply.

Rotation of the shaft causes the cutoff tool first to sever the wire, so that the loop extending through the guide groove and reentering the barrel has two free ends that pass through the two slots in the disk. Thereafter, the disk rotates, and the wire ends are urged by the slots to move diametrically inwardly to the inner ends of the slots. The latches engage the wire ends, and the disk continues to rotate and impart one or more twists to the wire, tightening the loop and joining the pair of bars engaged in the yoke.

In a further aspect, the invention provides a sliding mounting bracket for joining the yoke to the distal end of the barrel. The mounting bracket is arranged to translate parallel to the axis of the barrel, whereby at the end of the wire twisting cycle the operator of the tool may pull on the handle to cause the yoke to slide distally with respect to the barrel. This movement causes the twisted wire loop, which is secured about the rebars, to be withdrawn from the disk and the end plate; thereby freeing the tool from the rebars. A spring-biased latch immobilizes the sliding mounting bracket with respect to the barrel during the loop forming and tying process, and a solenoid actuator releases the latch at the end of the cycle to permit translation of the yoke.

In another aspect, the invention includes a wire guide mechanism for directing the wire end from the guide groove of the yoke to the inlet opening of the end plate of the barrel. The wire guide mechanism includes a tubular housing secured to the yoke along an axis parallel to the axis of the barrel and generally coaxial with the inlet opening. A tubular wire guide bushing is slidably secured in the housing, and a wire guide is secured concentrically within the wire guide bushing. The bushing includes a wire groove extending generally contiguously with the end of the guide groove of the yoke. The wire guide includes an end cap in confronting relationship to the inlet opening of the end plate, with a window in the end cap to permit the wire end to extend through the cap to the inlet opening.

As the feed mechanism drives the wire through the guide groove of the yoke, the wire end enters the wire groove of the bushing and impinges on the end cap adjacent to the window. Further advancement of the wire urges the wire guide bushing to extend from the housing toward the inlet opening. A cam pin engaged in a cam slot in the wire guide rotates the wire guide as the bushing reaches full extension from the housing, allowing the wire end to align with the window and to extend out of the window and enter the inlet opening. As the wire twisting disk begins to operate, it gathers the two sides of the wire loop and pulls the wire from the window, which also causes the wire to rotate the wire guide and permit the guide and bushing to retract under spring force into the housing.

The invention further includes electronic sensors and logic controls to respond to actuation of the pushbutton, provide properly timed and limited operation of the wire feed mechanism, rotation of the wire twisting and cutoff mechanism, and release of the yoke bracket latch mechanism.

BRIEF DESCRIPTION OF THE DRAWING

FIG. 12 is a plan view of the wire guide bushing of the hand tool of the invention.

FIG. 13 is an end view of the wire guide bushing depicted in FIG. 12.

FIG. 14 is a plan view of the wire guide disposed within the wire guide bushing depicted in FIGS. 12 and 13.

FIG. 15 is an end view of the end cap portion of the wire guide depicted in FIG. 14.

FIG. 16 is an end view of the end cam portion of the wire guide depicted in FIGS. 14 and 15.

FIG. 17 is a cross-sectional plan view of the wire guide assembly of the hand tool of the invention.

DESCRIPTION OF THE PREFERRED EMBODIMENT

The present invention generally comprises a portable hand tool for forming and installing wire ties to join bar or rod segments or the like and form a rigid structure therewith. Although the tool has great utility with respect to joining concrete reinforcing bars or rods, its uses may be extended to any task where it is possible to join objects with a twisted wire tie.

Figure 1:
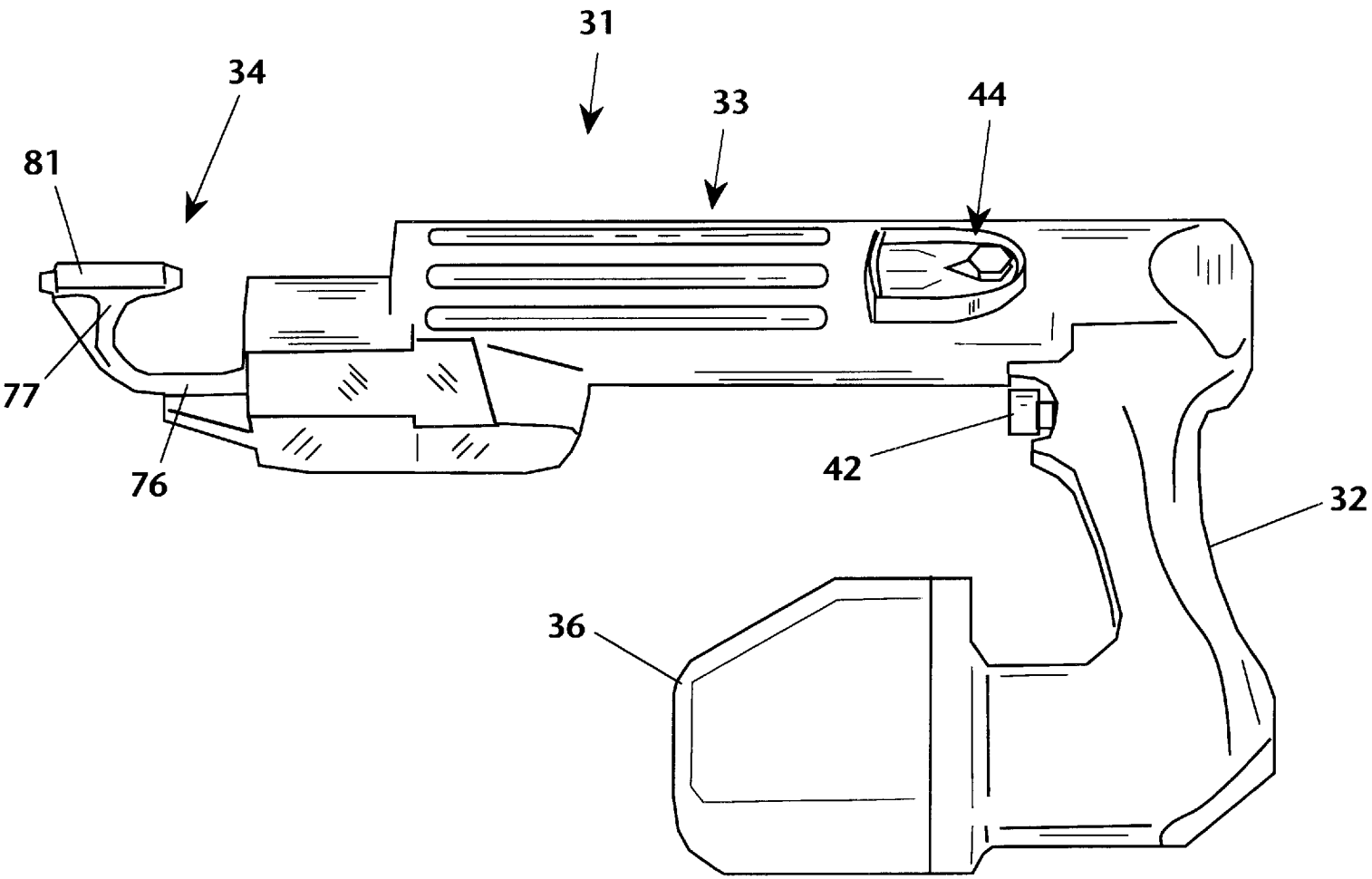
FIG. 1 is a perspective view of the hand tool for forming and applying wire ties of the present invention.
Figure 2:
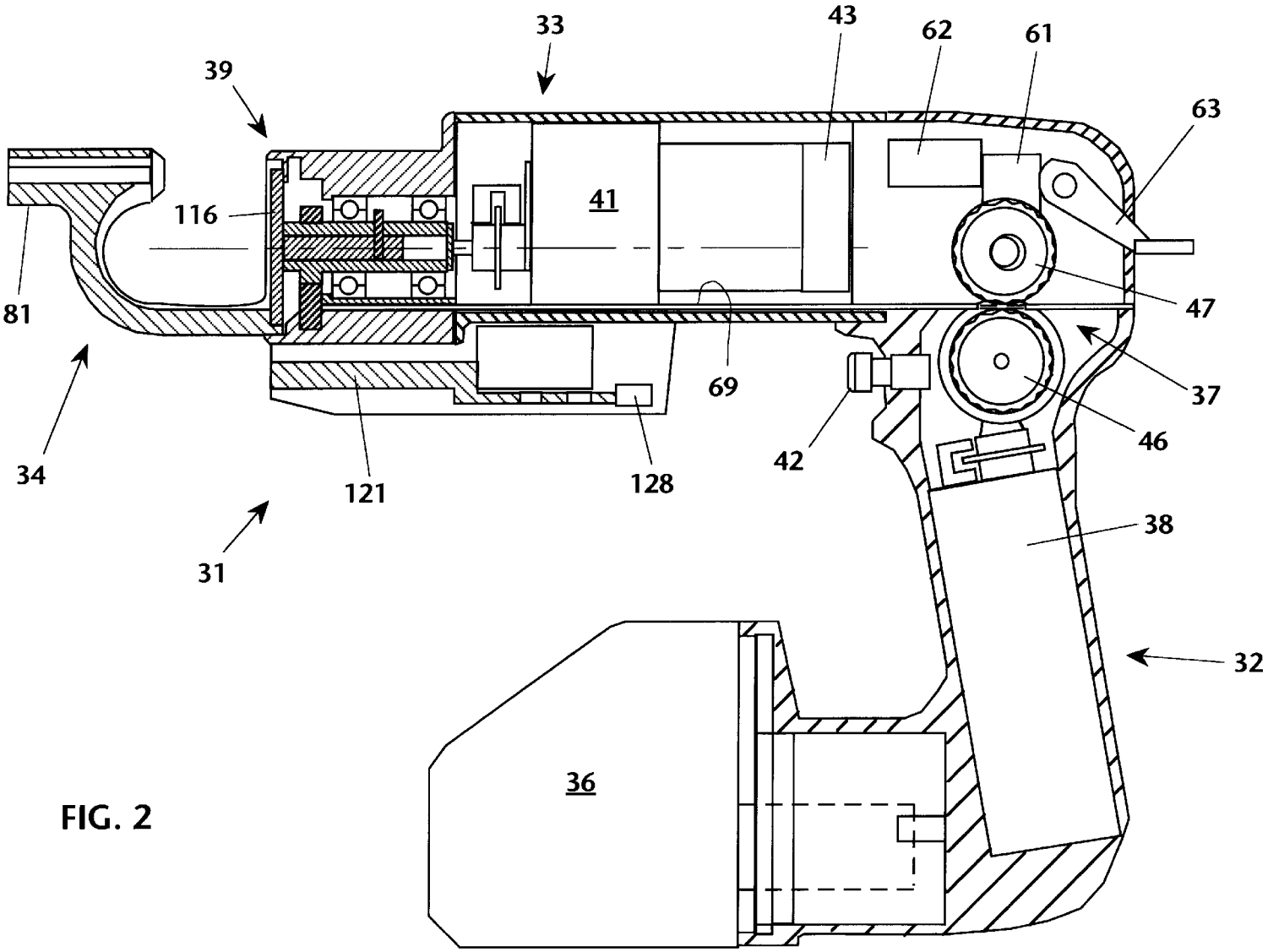
FIG. 2 is a cross-sectional plan view of the hand tool depicted in FIG. 1.
Figure 3:
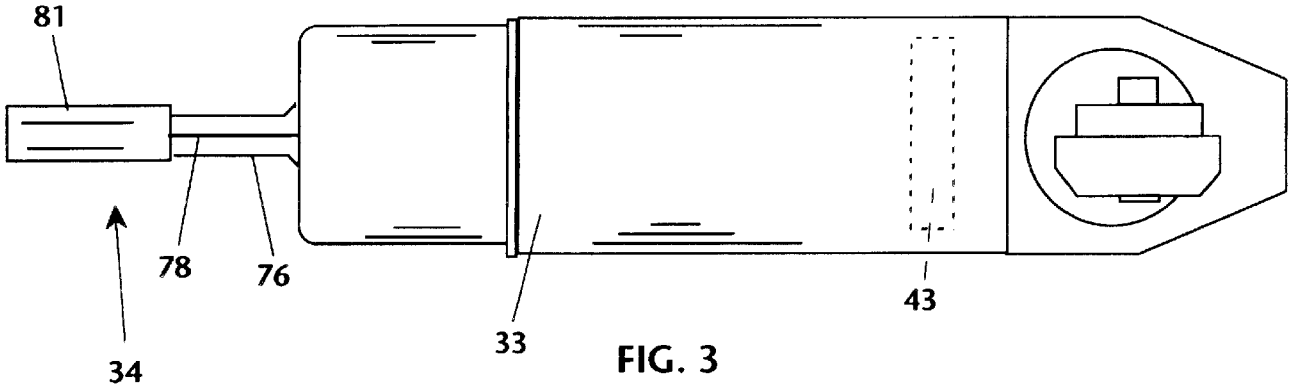
FIG. 3 is a top view of the hand tool depicted in FIGS. 1 and 2.

With regard to FIGS. 1 and 2, the hand tool 31 of the invention is formed in pistol fashion with a handle portion 32 joined to one end of an extended barrel portion 33. A wire-forming yoke 34 extends distally from the barrel portion 33, and a replaceable rechargeable battery power source 36 is secured to the lower end of the handle 32. A wire feed mechanism 37 is disposed within the tool at the junction of the handle 32 and barrel 33, with the wire feed motor 38 disposed in the handle portion. A wire cutting and twisting apparatus 39 is secured within a distal portion of the barrel 33, with the cutting and twisting motor 41 mounted in a medial portion of the barrel 33. A pushbutton control 42 is disposed at the vertex of the included angle between the barrel portion and handle portion. The pushbutton 42 is connected to a control circuit embodied on a circuit board 43, which in turn operates the wire feed motor 38 and the cut and twist motor 41 in proper sequence and timing. The tool may also be provided with a selector control 44 to set the desired number of twists applied to the twisted wire loop formed by the tool, as will be explained in the following description.

Figure 5:
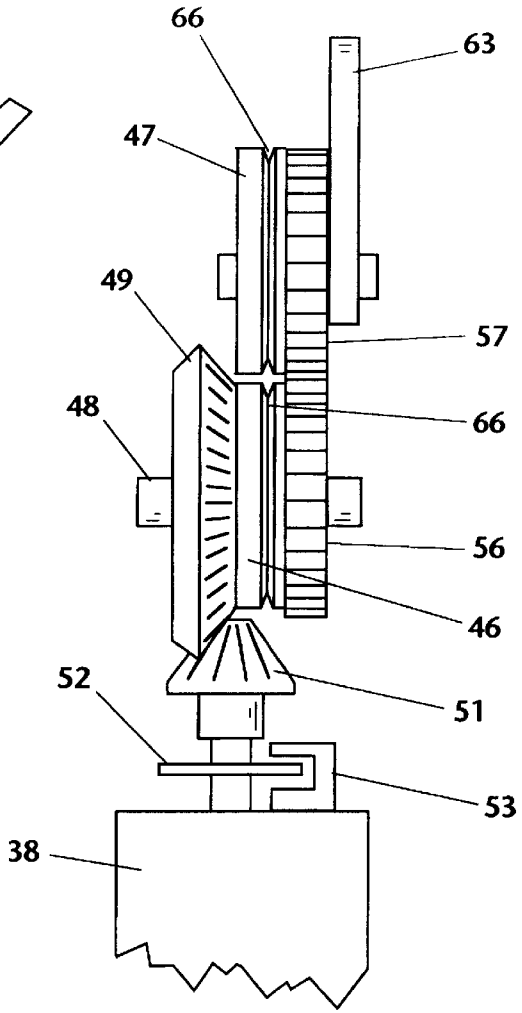
FIG. 5 is an isolated end view of the wire feed mechanism shown in FIG. 4.
Figure 4:
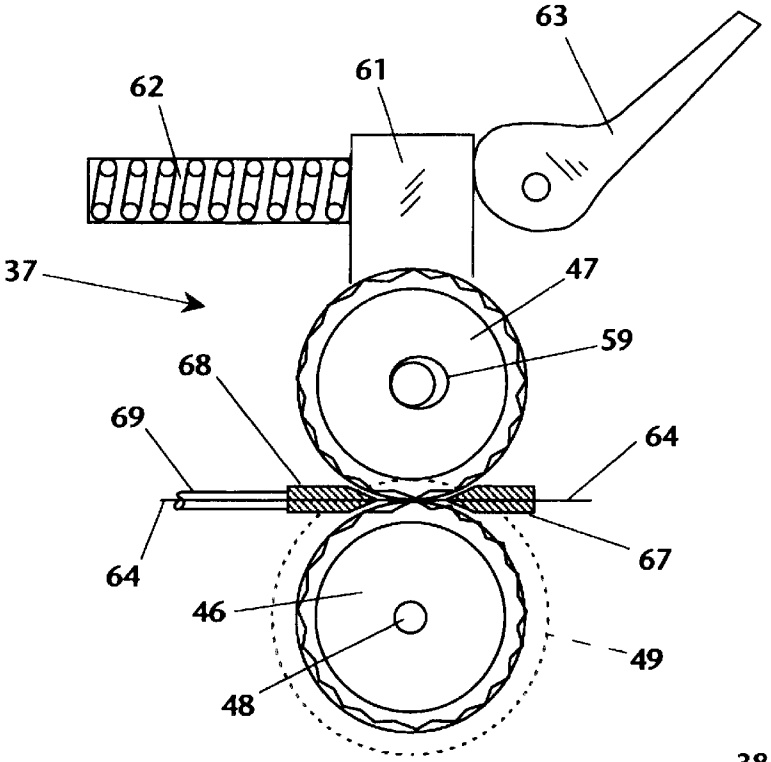
FIG. 4 is an isolated plan view of the wire feed mechanism of the wire tying tool of the present invention.
Figure 7:
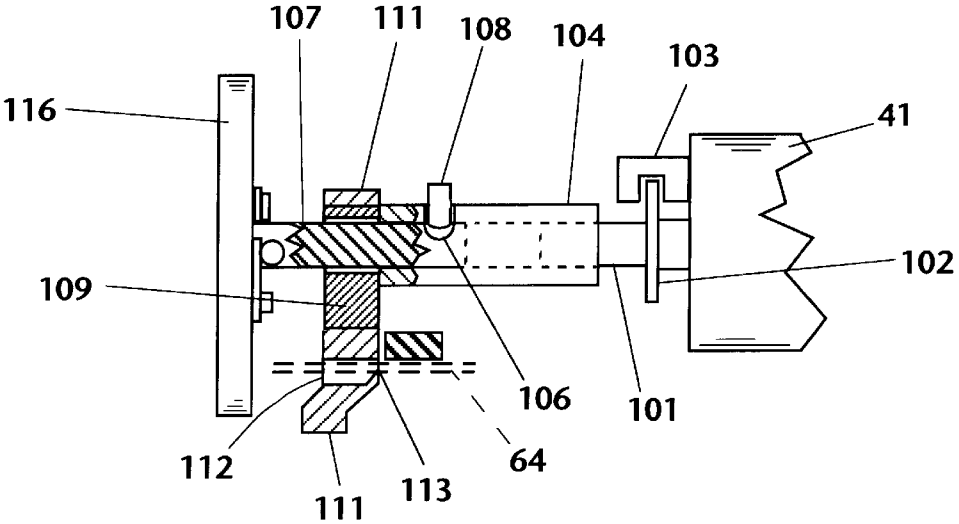
FIG. 7 is a partially cutaway plan view of the wire cutting and twisting apparatus depicted in FIG. 6.
Figure 9:
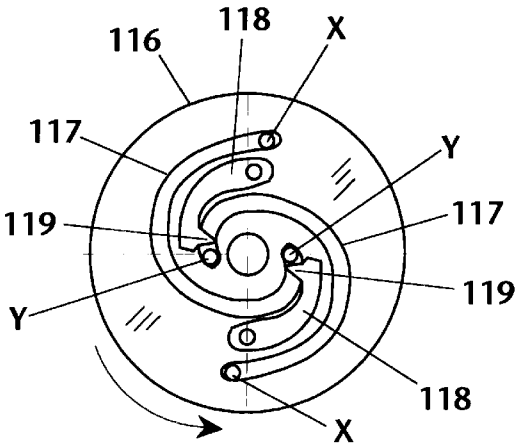
FIG. 9 is a rear view of the wire twisting disk of the wire cutting and twisting apparatus shown in FIGS. 6–8.
Figure 8:
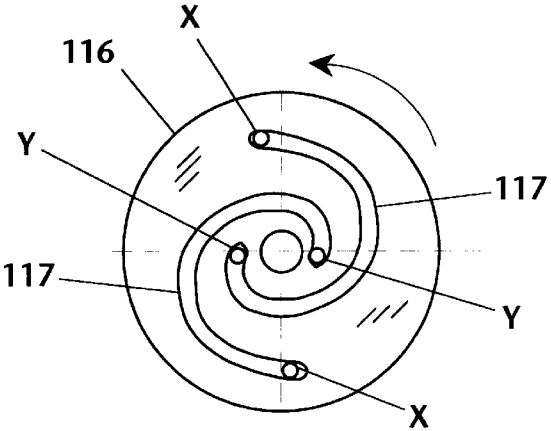
FIG. 8 is a front view of the wire twisting disk of the wire cutting and twisting apparatus shown in FIGS. 6 and 7.

With reference to FIGS. 4 and 5, the wire feed mechanism 37 includes a pair of wire rollers 46 and 47 disposed in edge-adjacent fashion. The roller 46 is mounted on a shaft 48 for rotation thereabout, and a beveled drive gear 49 is secured concentrically to the roller 46. A pinion gear 51 is secured to the output shaft of motor 38 and disposed to drive the beveled gear and thus the roller 46. A rotation indicator 52 is mounted on the output shaft, and a disk sensor 53 is disposed to monitor the angular excursion of the output shaft and generate a signal that is fed to the control circuit 43.

The rollers 46 and 47 are provided with integral drive gears 56 and 57, respectively, that are adapted to mesh, whereby roller 46 may drive roller 47 in opposed rotation. Roller 47 is movably operated by cam 59, which in turn is connected to cam lever 61. A spring 62 biases the cam lever 61 toward a wire release lever 63, which may be operated to move the cam 59 and bring the roller 47 into and out of impingement with the roller 46, thereby engaging or releasing a wire 64 fed from an outside supply reel. The rollers 46 and 47 are provided with annular grooves 66 which accommodate the diameter of the wire 64. The wire 64 is directed into the grooves 66 of the rollers by a wire support 67, and is directed by wire support 68 into feed tube 69, which extends distally in the barrel 33.

Figure 6:
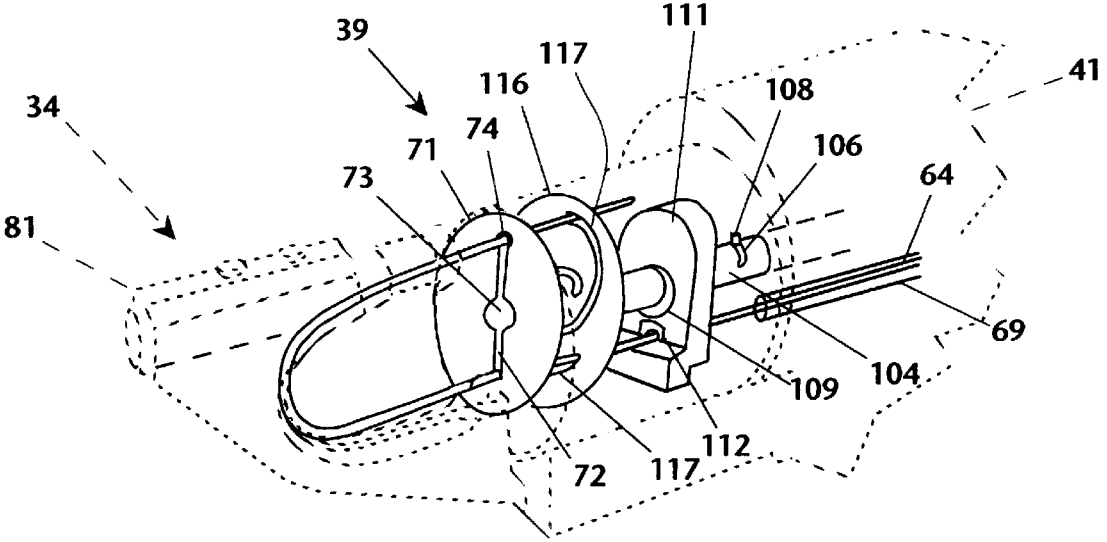
FIG. 6 is a perspective view of the wire cutting and twisting apparatus of the present invention.
Figure 10:
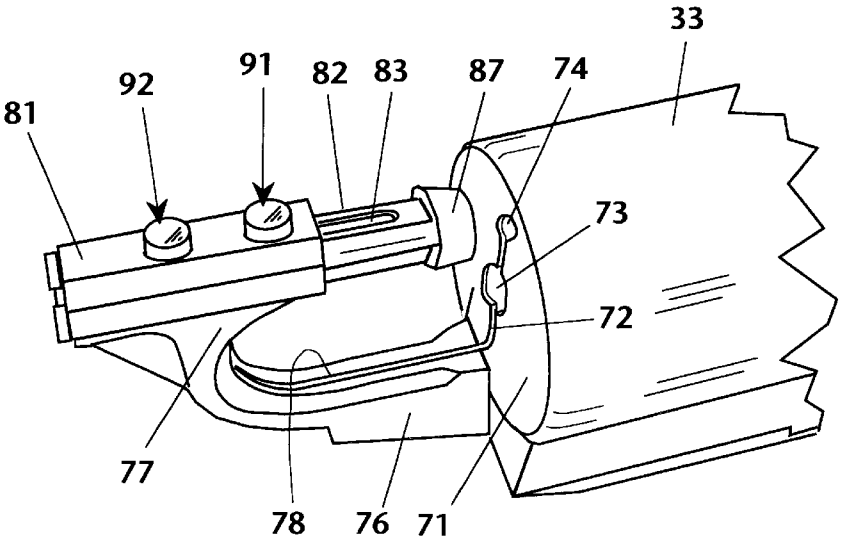
FIG. 10 is a bottom perspective view of the yoke portion of the hand tool of the invention.

The wire 64 is delivered to and through the wire cutting and twisting apparatus 39 to the distal end of the barrel 33. As shown in FIGS. 6 and 10, an end plate 71 at the distal end of the barrel is provided with a slot 72 extending diametrically therein. A generally circular opening 73 is disposed in a medial portion of the slot 72, and an inlet opening 74 is disposed at one end of the slot 72. Wire 64 exits the barrel from the other end of slot 72 and engages the yoke 34, where it is formed into a half-loop and redirected back to the wire twisting apparatus.

Figure 18A:
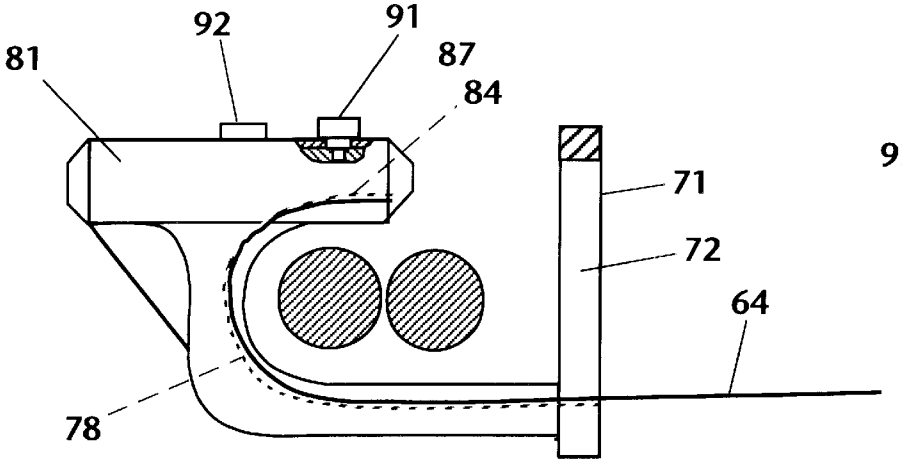
FIGS. 18*a*–18*d* are sequential side views showing progressive operation of the wire guide mechanism in relationship to the yoke and wire twisting apparatus of the invention.

With regard to FIGS. 1, 2, 10, 11, and 22, the yoke 34 includes a proximal linear portion 76 and a distal hook end 77 that is dimensioned to receive two or more reinforcing bars or the like. A guide groove 78 is formed in the yoke, extending from the wire outlet end of the slot 72 along the linear portion 78 and continuously in the inside surface of the hook portion 77. Thus the wire 64 is driven into the guide groove 78 by the feed mechanism 37 and directed to describe a half loop inside the hook portion 77 of the yoke, as shown in FIG. 18*a*.

With reference to FIGS. 12–17, secured to the upper distal end of the yoke 34 is a tubular housing 81 that supports a wire guide mechanism adapted to direct the wire 64 from the end of the guide groove 78 to the inlet opening 74 of the end plate 71. The housing 81 is disposed along an axis that is generally parallel to the axis of the barrel 33. Within the housing 81 is a wire guide bushing 82, comprising a sleeve-like component dimensioned for slidable translation within the housing. The bushing 82 is provided with a slot opening 83 disposed in an upper medial and proximal portion thereof and extending parallel to the axis. The bushing 82 also includes a wire groove 84 extending parallel to the axis and aligned with the guide groove 78.

A wire guide 86 is received within the bushing 82 in freely rotating fashion, the guide 86 and bushing 82 being coupled for translation in common. The wire guide 86 includes a truncated conical cap 87 at the proximal end and an annular cam 88 at the distal end. A cam groove 89 extends into the upper surface of the wire guide 86, the groove 89 having a dogleg configuration and being disposed in general registration with the slot 83. A cam pin 91 is fixedly secured to a proximal portion of the housing 81 and disposed to project through the slot opening 83 into the cam groove 89. In addition, a lock pin 92 is secured in a medial portion of the housing 81, and is disposed to translate along its axis. The lock pin 92 is spring-biased to project into the housing 81 and impinge on the outer surface of the wire guide bushing 82 as well as the peripheral camming surface of the annular cam 89, as will be described hereafter.

The cam 88 is provided with a peripheral camming surface that varies smoothly in diameter, with the smallest diameter portion 93 dimensioned to allow the lock pin 92 to project fully into the housing 81 and the largest diameter portion 94 dimensioned to impinge fully on the lock pin 92 and push the lock pin outwardly to clear the wire guide bushing. The wire guide cap 87, shown in FIGS. 20 and 21, includes an inner annular groove 96 disposed inside the cap adjacent to the cylindrical body of the wire guide 86. In addition, the cap 87 is provided with an outlet window 97 extending from the peripheral edge of the cap 87 to the cylindrical body of the wire guide 86, and thence annularly for a short distance.

Figure 18B:
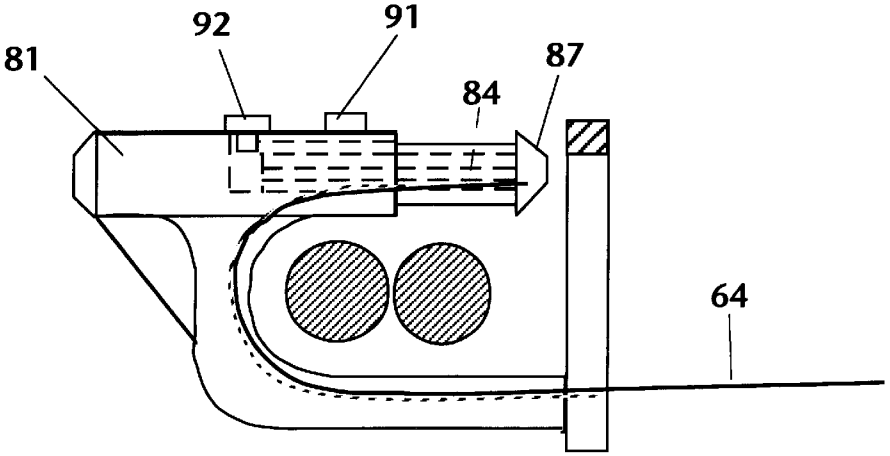

The wire guide mechanism is driven entirely by the force of the wire pushed therethrough by the feed mechanism. In the quiescent condition, the wire guide 86 and wire guide bushing 82 are retracted within the housing 81 (FIG. 18*a*), the cam pin 91 is disposed in position A (FIG. 14), and the wire guide 86 is spring biased clockwise as shown by the arrow in FIG. 19*a*. As the free end of wire 64 is fed through the guide groove 78 into the groove 84 of the bushing 82 it impinges on the inner annular groove 96 of the end cap 87 at a position that is adjacent to but not aligned with the outlet window 97. The wire end thus cannot exit from the cap; rather, it impinges on the end cap 87 with sufficient force to drive the wire guide 86 and wire guide bushing 82 to extend proximally from the housing 81, as shown in FIG. 18*b*.

Figure 19A:
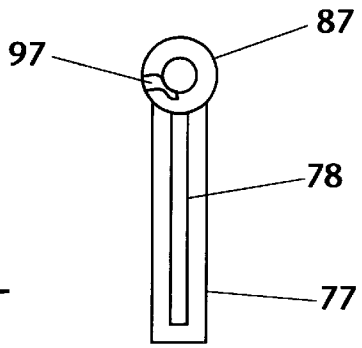
FIGS. 19*a*–19*d* are sequential side views showing progressive operation of the wire guide mechanism in correspondence with FIGS. 18*a*–18*d*.
Figure 19B:
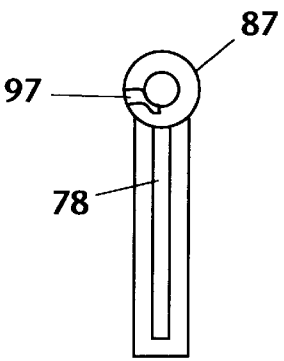
Figure 19C:
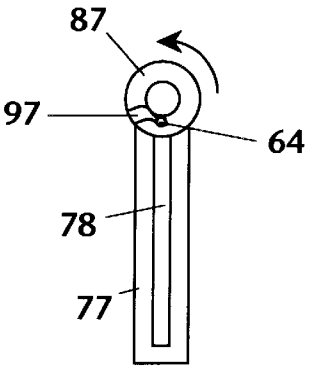
Figure 18C:
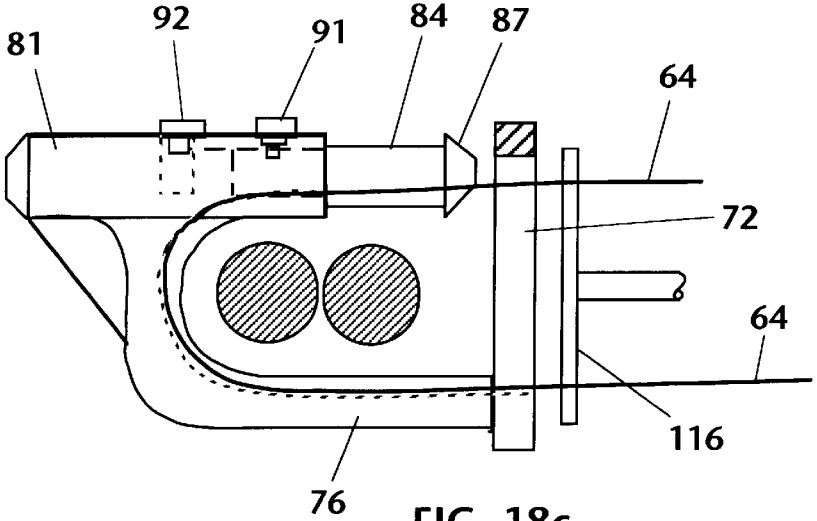
Figure 21:
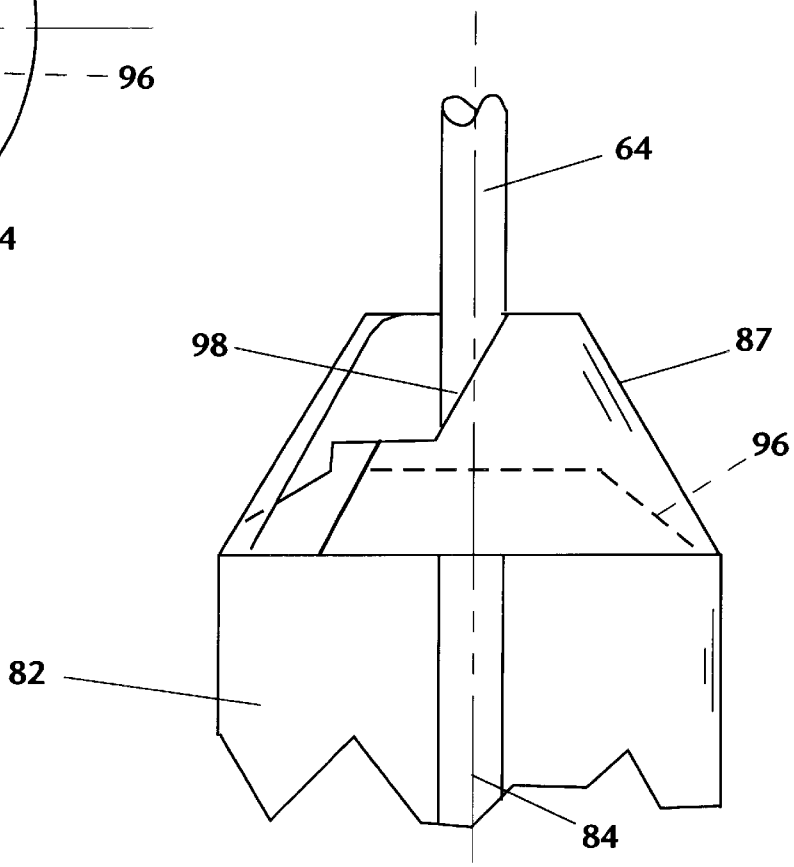
FIG. 21 is an enlarged side view of the end cap portion of the wire guide mechanism of the invention.
Figure 20:
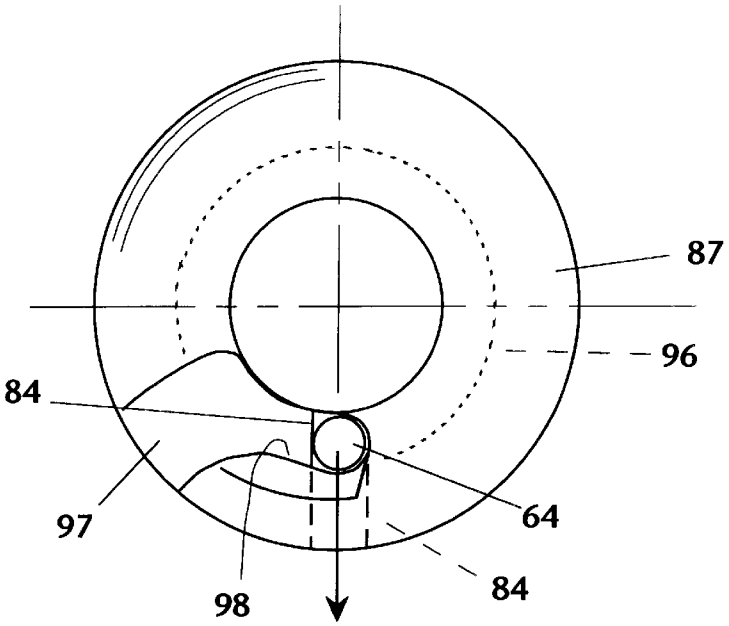
FIG. 20 is an enlarged end view of the end cap portion of the wire guide mechanism of the invention.

As the wire guide bushing 82 translates outwardly, cam pin 91 attains position B in the camming slot 89 (FIG. 14), and the lock pin 92 is urged by spring force radially inwardly in the housing 81 to prevent retraction of the wire guide bushing 82. At this point the end cap 87 is approaching the inlet opening 74 of the end plate of the barrel, and the mechanism is in the disposition shown in FIGS. 18*b* and 19*b*. Further translation of the wire guide bushing 82 and wire guide 86 causes cam pin 91 to impinge on the oblique surface of cam groove 89, moving to position C in FIG. 14 and driving the wire guide 86 to rotate counterclockwise slightly within the wire guide bushing, as indicated in FIG. 19*c*. This rotation brings the inner extent of window 97 into alignment with the wire groove 84 of the wire guide bushing, as shown in FIGS. 20 and 21, freeing the wire end to extend outwardly from the end cap 87 and pass into the inlet opening 74 of the front end plate 71, as shown in FIG. 18*c* and 19*c*. Thus the wire end is delivered precisely and reliably to return to the barrel and to the wire cutting and twisting apparatus.

Figure 19D:
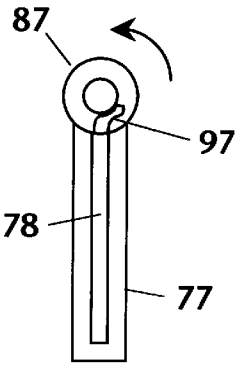
Figure 18D:
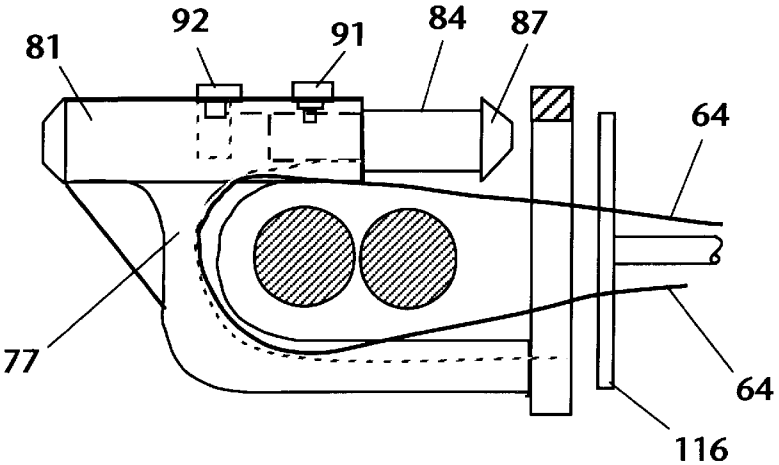

As the wire exits the wire guide end cap 87, there in no longer any driving force being applied by the wire to extend the wire guide and wire guide bushing. These components retract into housing 81 under spring bias and are blocked by the inward position of pin 92. Subsequent operation of the wire twisting apparatus initially causes the two sides of the wire loop to be gathered together, as shown in FIG. 18*d*, pulling the wire from the window 97 and from the groove 84 of the wire guide bushing. As the wire is pulled from window 97, as shown by the arrow in FIG. 20, the wire exerts force on the cammed edge 98 of window 97, urging the wire guide 86 to rotate further counterclockwise, as shown in FIG. 19*d*. Cam pin 91 moves to position D in FIG. 14. This further rotation brings the wider portion 94 of cam 88 into impingement with lock pin 92, driving the pin 92 outwardly in housing 81 and causing it to clear the wire guide bushing 82. The bushing and wire guide 86 are thus free to retract, as cam pin 91 moves to position E in FIG. 14, and the internal torsion and compression springs rotate the wire guide 86 clockwise, as indicated in FIG. 19*a*, whereby the mechanism is completely retracted and restored to the quiescent position in preparation for the next wire dispensing cycle.

With reference to FIGS. 6–9, the wire cutting and twisting mechanism 39 includes the motor 41 having an output shaft 101. A rotation indicator 102 is mounted on the output shaft, and a disk sensor 103 is disposed to monitor the angular excursion of the output shaft and generate a signal that is fed to the control circuit 43. A drive sleeve 104 is secured coaxially to the end of shaft 101, the sleeve 104 including a slot 106 extending annularly therein and subtending an angle of approximately 90°. A secondary drive shaft 107 is received in freely rotating fashion in the distal end of sleeve 104, and a linking pin 108 extends radially from shaft 107 and protrudes through slot 106. An annular cam 109 is fixedly secured to the distal end of sleeve 104 in eccentric relationship, the secondary shaft 107 extending through an opening in the cam in freely rotating fashion.

The mechanism 39 further includes a wire cutting tool 111 disposed in the barrel and adapted to translate reciprocally transverse to the axis of the barrel. The tool 111 includes an opening 112 extending therethrough parallel to the axis of the barrel and aligned with the wire delivery tube 69. One edge of the opening 112 is formed as a shear 113. A central opening in the tool 111 is dimensioned to receive the cam 109 in freely rotating fashion.

Secured fixedly and coaxially to the distal end of shaft 107 is a wire twisting disk 116. Disk 116 is provided with a pair of curved slots 117 disposed symmetrically with respect to the axis of rotation of the disk. Each slot 117 is curved in a partial spiral, with the outer ends of the slots 117 disposed initially in registration with the inlet opening 74 of the end plate and the opening 112 of the cutoff tool 111. Each slot 117 describes a curvature of approximately 270°. Joined to the proximal face of the disk 116 are a pair of wire latches 118, each associated with one of the slots 117. Each latch 118 is pivotally secured to the disk, and includes a detent 119 extending across the respective slot 117. The latches are spring biased toward the axis of the disk, and the detents are arranged so that a wire extending through its slot may translate along the slot and progress radially inwardly from position X, and push past the detent as it arrives at position Y at the inner end of the slot. Thereafter the spring force urges the latches inwardly, and the detent 119 prevents the wire from moving retrograde from position Y.

The apparatus 39 is disposed initially in a quiescent condition in which the opening 112 of the tool 111 is aligned with the wire directing tube 69 and with the outer end of one of the slots 117, and with the outlet end of slot 72 in the end plate of the barrel. The outer end of the other slot 117 is aligned with the inlet opening 74 of the slot 72. The wire feed mechanism is actuated as described previously, resulting in the wire being driven through the opening 112, position X of one slot 117, and the outlet end of slot 72. The wire is then formed into a half loop and directed back into the inlet opening 74, as described above, and to extend through position X of the other slot 117, as shown in FIG. 6. The wire feed mechanism is controlled to stop at this point.

Figure 22:
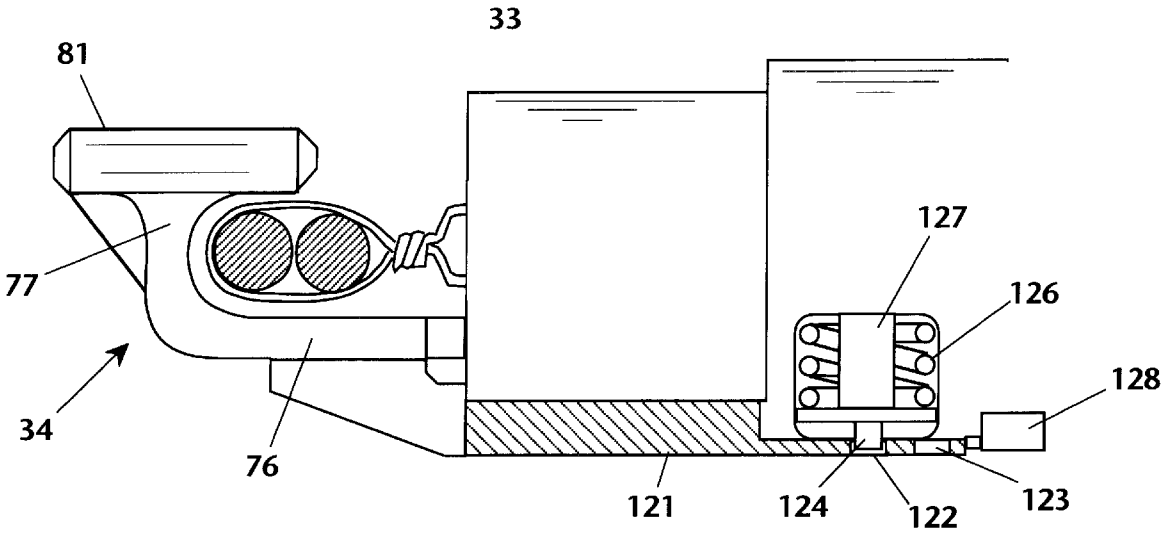
FIG. 22 is a partially cross-sectioned side elevation of the yoke assembly to the barrel portion of the hand tool, showing the yoke and latch mechanism in a closed locked disposition.

The motor 41 is then actuated by the control circuit, causing the shaft 101 and sleeve 104 to begin to rotate counterclockwise as viewed in FIG. 6. Shaft 107 remains stationary while sleeve 104 and cam 109 rotate, driving the cutting tool 111 to translate and causing shear 113 to sever the wire portion extending from the feed mechanism to the yoke 34. Thus the wire loop formed in the yoke has two free ends extending through positions X of the slots 117. After approximately 90° of rotation of sleeve 104, the end of slot 106 impinges on pin 108, and shaft 107 and disk 116 are driven thereafter to rotate in common with sleeve 104. The two legs of the wire loop are constrained to remain in the plane of the slot 72, while the inwardly spiraling slots 117 urge the legs radially inwardly, drawing the legs together as indicated in FIG. 18*d*. After approximately 270° rotation of the disk 116, the legs of the loop pass the detents 119 of latches 118, and are thereafter locked at positions Y of the grooves 117. In this disposition both legs extend through central opening 73. The motor 41 continues to rotate the disk 116 for a predetermined number of complete revolutions, imparting a selected number of twists to the legs of the loop and completing the closure and securance of the wire loop, as shown in FIG. 22. It may be appreciated that the twisting action also tightens the loop about the bars entrained within the yoke, joining the bars in a rigid conjunction.

Figure 11:
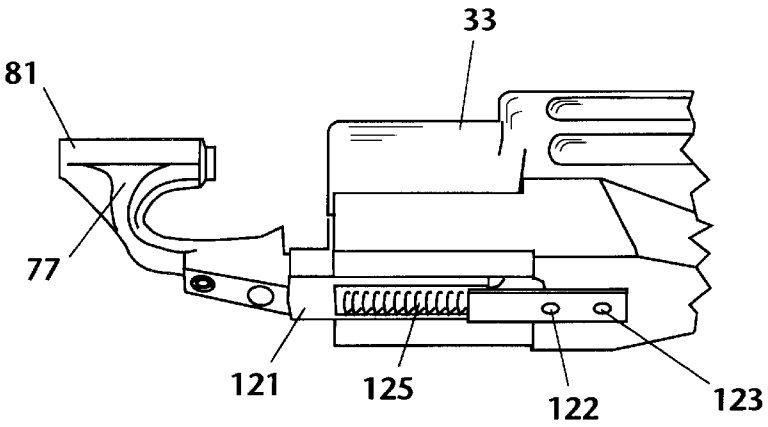
FIG. 11 is a top perspective view of the yoke portion of the hand tool of the invention.
Figure 23:
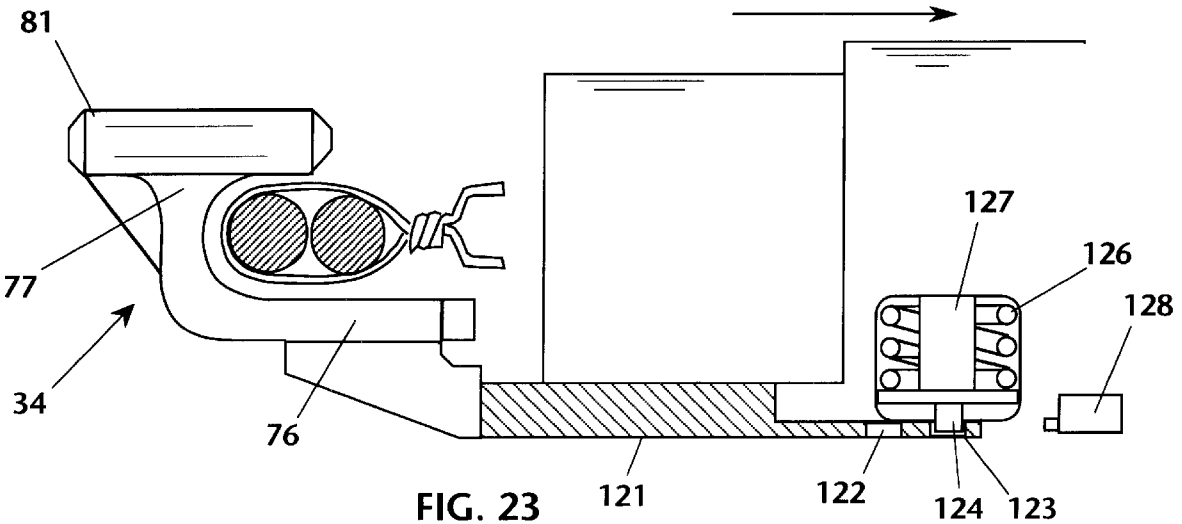
FIG. 23 is a partially cross-sectioned side elevation of the yoke assembly to the barrel portion of the hand tool, showing the yoke and latch mechanism in an open, unlocked disposition.

With regard to FIGS. 11, 22, and 23, the yoke assembly 34 is supported by a bracket 121 which is secured by a dovetail engagement with the barrel 33 and arranged to translate slidably parallel to the axis of the barrel. The bracket 121 includes a pair of detent holes 122 and 123 spaced longitudinally and disposed to be engaged by a detent pin 124. The detent pin 124 is biased by spring 126 to extend outwardly and engage either of the holes, and a solenoid 127 is joined to the pin 124 to selectively retract the pin 124 and release its engagement with either of the holes 122 or 123. A switch 128 is secured to the barrel and disposed to be actuated when the bracket 121 is in the disposition shown in FIG. 22, corresponding to the pin 124 being engaged in hole 122. A compression spring 125 is coupled between the barrel 33 and the bracket 121 (FIG. 11).

The entire wire dispensing, looping, cutting and twisting cycle described in the foregoing occurs while the yoke 34 and sliding bracket 121 are disposed as shown in FIG. 22. When the motor 41 is shut off by the control circuit at the end of the twisting cycle, the control circuit actuates the solenoid 127 to retract the pin 124 and disengage the hole 122. Thereafter the tool operator may pull on the handle 32, as shown by the arrow in FIG. 23, causing the yoke 34 and bracket 121 to translate distally with respect to the barrel against the force of spring 125. This action causes the twisted wire loop to be pulled from the slot 72, thereby separating the wire loop from the twisting disk and front end plate 71. Also, this translation opens a wider gap between the housing 81 and the end plate 71, permitting easier disengagement of the yoke from the rebars within the hook portion thereof.

When the sliding bracket translates distally, switch 128 is no longer actuated by contact therewith, causing the solenoid to shut off. As the bracket translates and hole 123 becomes aligned with pin 124, the force of spring 126 urges the pin 124 to engage hole 123, locking the sliding bracket in the extended position of FIG. 23. After a preset time period, the control circuit will re-actuate the solenoid and release the pin 124 from hole 123, and the force of spring 125 will restore the bracket 121 and yoke 34 to the disposition shown in FIG. 22. Thus the yoke and bracket 121 are prepared for the next wire loop dispensing and twisting cycle.

The control knob 44 is connected to the control circuit to enable the tool operator to select the number of twists applied to the wire loop by the apparatus 39. The number of twists is related to the tightness of the wire loop about the rebars, and may also allow the operator to adjust the wire loop to accommodate rebar of differing diameters.

Although the description of the operation of the tool of the invention involves a lengthy explanation of several interrelated systems, to the operator of the tool the operation is extremely simple. The operator need only secure the hook portion of the yoke about the bars to be joined, and push the button 42. Thereafter the entire dispensing, cutting and twisting cycle requires only a few seconds to be carried out, with no other manual effort required by the operator. The operator then pulls on the handle to extend the yoke and free the tied bars, and the tool is then available to apply another wire loop. A wire supply reel may be secured adjacent to the proximal end of the barrel. Using a nominal wire gauge and a standard supply reel, the tool may dispense approximately 700 twisted wire loops from a single reel and a single battery charge.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. Apparatus for forming and applying a twisted wire loop, including:

means for forming a half-loop of wire about an object, said half-loop including two adjacent wire legs extending from a medial curved portion;

means for twisting said two wire legs to form a closed loop about the object including a wire twisting tool, and a pair of slots formed in said tool, each of said pair of slots adapted to engage one leg of said half-loop;

means for rotating said tool about an axis;

said slots being formed to curve inwardly toward said axis, whereby said wire legs are gathered toward said axis as said tool is rotated;

said slots including inner ends adjacent to said axis, and further including detent means for latching said wire legs at said inner ends of said slots.

2. The apparatus of claim 1, further including means for constraining like portions of said wire legs to remain in a common plane while said twisting tool is rotated to twist other portions of said wire legs about said axis.

3. The apparatus of claim 1, further including wire feed means for delivering a continuous length of wire to said means for forming.

4. The apparatus of claim 3, wherein said slots include outer ends, and said continuous length of wire extends through said outer end of one of said slots.

5. The apparatus of claim 4, further including cutting means for cutting said continuous length of wire and defining one of said legs of said half-loop.

6. The apparatus of claim 5, wherein said cutting means is disposed adjacent to said twisting tool.

7. The apparatus of claim 6, wherein said means for rotating said tool also operates said cutting means.

8. The apparatus of claim 1, wherein said means for forming includes a yoke having a wire guide groove, and means for feeding a continuous segment of wire through said guide groove.

9. The apparatus of claim 8, wherein said guide groove includes a curved portion adapted to impart the curvature of said half-loop to said continuous segment of wire as said continuous segment is fed through said guide groove.

10. Apparatus for forming and applying a twisted wire loop, including;

a barrel assembly having a distal end;

a yoke assembly extending distally from said distal end, said yoke assembly including means for forming a half-loop of wire about an object, said half-loop including first and second wire legs extending from a medial curved portion;

means for twisting said first and second legs to form a closed loop about the object;

said means for forming including a wire guide groove extending in said yoke and having a curvature substantially similar to said half-loop, and means for feeding a continuous segment of wire into said guide groove to impart said curvature to said segment of wire;

said means for twisting including a wire twisting tool, and first and second slots formed in said tool and disposed to engage respective first and second legs of said half-loop;

means for rotating said tool about an axis;

said distal end of said barrel includes a fixed slot extending therein and disposed transverse to said axis.

11. The apparatus of claim 10, wherein said fixed slot includes a first end, and said first leg extends through said first slot of said tool and through said first end of said fixed slot to enter said wire guide groove.

12. The apparatus of claim 11, wherein said fixed slot includes a second end, and further including means for conducting said second leg of said half-loop from said wire guide groove to said second end of said fixed slot.

13. The apparatus of claim 12, wherein said first and second slots of said wire twisting tool are each formed in an inwardly spiraling curved fashion, whereby said first and second legs are drawn together toward said axis as said twisting tool is rotated.

14. The apparatus of claim 13, wherein said first and second slots include inner ends adjacent to said axis, and further including detent means for latching said first and second wire legs at said inner ends of said first and second slots.

15. The apparatus of claim 12, wherein said means for conducting includes a wire guide bushing reciprocally translation from said yoke assembly toward said second end of said fixed slot.

16. The apparatus of claim 15, wherein said means for reciprocally translating includes a wire guide bushing, and further including a wire guide dowel disposed within said wire guide bushing and adapted for reciprocal translation therewith, said dowel being rotatably secured within said wire guide bushing.

17. The apparatus of claim 16, further including a capture groove within said guide dowel for engaging a free end of said second leg as said means for feeding advances said segment of wire through said wire guide groove to said means for conducting.

18. The apparatus of claim 17, wherein the force of advancement of said free end of said second leg drives said wire guide bushing to translate toward said second end of said fixed slot.

19. The apparatus of claim 18, further including means for releasing said free end of said second leg from said capture groove as said wire guide bushing and guide dowel translate to a predetermined limit from said yoke assembly.

20. The apparatus of claim 19, wherein said means for releasing include a camming groove extending longitudinally in said guide dowel, and a cam pin fixedly secured in said yoke assembly and extending into said camming groove.

21. The apparatus of claim 20, wherein said capture groove includes an outlet window, and said camming groove includes means for rotating said guide dowel to align said outlet window with said free end of said second leg as said guide dowel translates to said predetermined limit.

22. The apparatus of claim 21, wherein said wire guide bushing includes a bushing groove extending substantially contiguously with said guide groove of said yoke assembly.

23. The apparatus of claim 11, further including means for cutting said continuous segment of wire, said means for cutting disposed adjacent to said first slot of said wire twisting tool to sever said first leg from said continuous segment.

24. The apparatus of claim 23, wherein said means for rotating said wire twisting tool also operates said means for cutting said continuous segment of wire.

25. The apparatus of claim 10, wherein said means for feeding a continuous segment of wire includes a pair of wire rollers secured within said barrel, and means for feeding said segment of wire between said rollers.

26. The apparatus of claim 25, further including motor means for driving one of said rollers, and means for sensing the rotation of said one roller to measure the length of said segment of wire advanced by said rollers to said yoke assembly.

27. The apparatus of claim 26, further including a handle joined to a proximal end of said barrel assembly in pistol fashion.

28. The apparatus of claim 27, wherein said motor means for driving one of said rollers is disposed within said handle.

29. The apparatus of claim 28, wherein said pair of wire rollers is disposed within said proximal end of said barrel assembly.

30. The apparatus of claim 29, wherein said means for twisting said first and second legs is disposed in a distal end portion of said barrel assembly adjacent to said yoke assembly.

31. The apparatus of claim 30, further including a wire delivery tube extending longitudinally in said barrel assembly from said pair of wire rollers to said means for twisting said first and second legs.

32. Apparatus for forming and applying a twisted wire loop, including:

means for forming a half-loop of wire about an object, said half-loop including two adjacent wire legs extending from a medial curved portion;

means for twisting said two wire legs to form a closed loop about the object, said means for twisting including a wire twisting tool, and a pair of slots formed in said tool, each of said pair of slots adapted to engage one leg to said half-loop;

means for rotating said tool about an axis, said slots being formed to curve inwardly toward said axis;

means for constraining like protins of said wire legs to remain in a common plane while said twisting tool is rotated to twist other portions of said wire legs about said axis.

33. The apparatus of claim 32, wherein said means for constraining like portions of said wire legs includes a fixed slot in said apparatus adjacent to said wire twisting tool, said fixed slot extending generally perpendicular to said axis, said like portions of said two wire legs passing through said fixed slot and retained in a generally planar relationship as said tool is rotated.

34. Apparatus for forming and applying a twisted wire loop, including;

a barrel assembly having a distal end;

a yoke assembly extending distally from said distal end, said yoke assembly including means for forming a half-loop of wire about an object, said half-loop including first and second wire legs extending from a medial curved portion;

means for twisting said first and second legs to form a closed loop about the object;

said means for twisting including a wire twisting tool, and first and second slots formed in said tool and disposed to engage respective first and second legs of said half-loop;

means for rotating said tool about an axis;

said distal end of said barrel including a fixed slot extending therein and disposed transverse to said axis, said first and second legs extending through said fixed slot.

35. Apparatus for forming and applying a twisted wire loop, including;

a barrel assembly having a distal end;

a yoke assembly extending distally from said distal end, said yoke assembly including means for forming a half-loop of wire about an object, said half-loop including first and second wire legs extending from a medial curved portion;

means for twisting said first and second legs to form a closed loop about the object;

a gap defined between said yoke assembly and said distal end;

means for feeding a continuous segment of wire through said means for forming a half-loop, said wire traversing said gap;

means for reciprocally translating from said yoke assembly across said gap and conducting said wire to traverse said gap.

36. The apparatus of claim 35, further including sliding bracket means for joining said yoke assembly to said distal end of said barrel assembly, whereby said yoke assembly is reciprocally displaceable from said distal end of said barrel to facilitate release of the object and twisted wire loop.

* * * * *